US010012360B2

(12) United States Patent
Blair et al.

(10) Patent No.: US 10,012,360 B2
(45) **Date of Patent: *Jul. 3, 2018**

(54) RETROFIT LED LIGHT PANEL

(71) Applicant: The LED Source, Inc., San Diego, CA (US)

(72) Inventors: George R. Blair, San Diego, CA (US); Jeff R. Blair, San Diego, CA (US); James Docherty, Santee, CA (US); Brent R. Noon, Rancho Santa Fe, CA (US)

(73) Assignee: The LED Source, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/823,981

(22) Filed: Nov. 28, 2017

(65) Prior Publication Data

US 2018/0080621 A1 Mar. 22, 2018

Related U.S. Application Data

(63) Continuation of application No. 15/340,322, filed on Nov. 1, 2016, now Pat. No. 9,835,307.

(60) Provisional application No. 62/376,301, filed on Aug. 17, 2016.

(51) Int. Cl.

| | |
|---|---|
| ***F21V 3/02*** | (2006.01) |
| ***F21V 23/00*** | (2015.01) |
| ***F21V 17/16*** | (2006.01) |
| ***F21S 8/02*** | (2006.01) |
| ***F21V 17/12*** | (2006.01) |
| *F21Y 103/10* | (2016.01) |
| *F21Y 115/10* | (2016.01) |

(52) U.S. Cl.

CPC ..... *F21V 3/02* (2013.01); *F21S 8/026* (2013.01); *F21V 17/12* (2013.01); *F21V 17/16* (2013.01); *F21V 23/003* (2013.01); *F21Y 2103/10* (2016.08); *F21Y 2115/10* (2016.08)

(58) Field of Classification Search

CPC . F21V 3/02; F21V 17/12; F21V 17/16; F21V 23/003; F21S 8/026; F21Y 2103/10; F21Y 2115/10

See application file for complete search history.

(56) References Cited

U.S. PATENT DOCUMENTS

| | | | | |
|---|---|---|---|---|
| 3,308,288 | A | 3/1967 | Ades | |
| 7,909,487 | B1 | 3/2011 | Venetucci et al. | |
| 9,835,307 | B1 * | 12/2017 | Blair | F21V 3/02 |
| 2009/0086474 | A1 | 4/2009 | Chou | |
| 2009/0135608 | A1 | 5/2009 | Sell | |

(Continued)

*Primary Examiner* — Mary Ellen Bowman

(74) *Attorney, Agent, or Firm* — Kelly & Kelley, LLP

(57) ABSTRACT

A retrofit panel for a ceiling-mounted light fixture. The panel may comprise a lens, screen, diffuser, or LED light screen. Anchor line assemblies and retainer arm assemblies extend from a perimeter guide track from which they extend. The anchor line assemblies engage one or more ports on the light fixture housing and hold the retrofit panel a maximum anchor distance from the housing. The retainer arm assemblies engage one or more openings on the light fixture housing and hold the retrofit panel flush with the light fixture housing or the ceiling if recess mounted. The retrofit panel can be easily installed in existing ceiling mounted light fixtures with minimal demolition.

20 Claims, 14 Drawing Sheets

(56) References Cited

U.S. PATENT DOCUMENTS

| | | | | |
|---|---|---|---|---|
| 2013/0033861 | A1 | 2/2013 | Orton | |
| 2013/0039074 | A1* | 2/2013 | Ding | F21S 8/04 362/311.01 |
| 2013/0044512 | A1* | 2/2013 | Araki | F21S 8/04 362/607 |
| 2013/0070455 | A1* | 3/2013 | Tsui | F21S 8/026 362/235 |
| 2015/0023010 | A1 | 1/2015 | Rozek et al. | |
| 2015/0085476 | A1 | 3/2015 | Mandy et al. | |
| 2015/0267873 | A1* | 9/2015 | Price | F21V 21/03 362/235 |

* cited by examiner

RETROFIT LED LIGHT PANEL

BACKGROUND OF THE INVENTION

The present invention is directed to a retrofit panel for use with existing ceiling-mounted light housings. More particularly, the present invention is a retrofit LED light panel that includes adjustable anchor wires and retention clips, along with a sliding channel, so as to quickly and easily replace a lens on existing ceiling-mounted fluorescent light fixtures.

Fluorescent lights have been commonly and widely used because of their energy saving features. Most fluorescent lights have a generally rectangular or square housing that can be installed in any type of ceiling with the housing recessed into the ceiling. By way of example only, such types of ceilings might include dry wall, stucco, drop panel and hard lid ceilings—to name a few. In some cases, the housing may be surface mounted on the ceiling. The ballasts and fluorescent tubes of fluorescent lights are typically spread throughout the housing with a lens secured into the opening of the housing flush with the housing or the ceiling. Because of their popularity and ease of use, fluorescent light fixtures are presently installed in countless numbers across the world.

New types of lights such as light emitting diodes (LED's) are oftentimes more desirable to use because of their improved output, decreased energy consumption, and increased lifespan compared to other forms of light sources, including fluorescent lights.

While there exists technology to replace fluorescent bulbs with LED tube bulbs, such LED tube bulbs are more expensive than fluorescent bulbs and can be time consuming to install into existing light fixtures. Replacing fluorescent bulbs with LED tube bulbs requires replacing the ballasts and components in existing fixtures. While such concerns exist when replacing one light fixture, such concerns are especially problematic for office or apartment buildings (and similar locations) that contain a large number of light fixtures. Upgrading and/or replacing every light fixture in such a building can very quickly become unreasonably expensive. In addition, such LED tube bulbs often times require different drivers (either internal to the bulb or external) and/or control switches that involve further upgrades. The use of direct current LED tube bulbs is also discouraged by energy companies, which is why no rebates are usually given for such replacements.

Recently, some manufactures have been making LED panels that are designed and constructed to wholly replace fluorescent light fixtures. These LED panels are configured to occupy the same space in the ceiling as the fluorescent light housing. In new construction, this means that the same size opening is left in a ceiling, but instead of installing a fluorescent light fixture, the builder simply installs the LED panel instead. In the case of a hard lid ceiling, drop ceiling type material is used to prepare for a flat panel. Such new installations are not a problematic in new construction because there are no old installations to remove or replace and there is no waste of which to dispose.

In contrast, retrofitting a fluorescent light fixture with an LED panel requires removing the entire fluorescent light fixture, e.g., lens, bulbs, ballasts, and housing, which are difficult and expensive to dispose of because they are considered hazardous materials. While the housing and ballasts can typically be removed as one unit, the lens and fluorescent bulbs must generally be removed separately for safety. In addition, the ballasts must be separated from the housing for proper disposal along with the fluorescent bulbs—all of which are considered hazardous materials. The added time and expense associated with such complete removal in the case of retrofitting can become extremely burdensome. Such is especially true in the case of large office buildings, apartments, hotels, etc.

There are also concerns with retrofitting in certain types of buildings such as hospitals or similar types of regulated buildings that may have specific requirements for retrofitting. Some hospitals or applicable state laws often require that ceiling-mounted light fixtures be appropriately anchored, where existing fluorescent light fixtures would have such anchoring. If an existing anchored light fixture is removed from a ceiling for retrofitting, such building or regulation would likely require that construction plans be drawn-up and permits be pulled. These would add further expense to a retrofit of existing fluorescent light fixtures with LED panels.

Accordingly, there is a need for an LED panel system that can be easily retrofitted into existing ceiling-mounted light fixtures with minimal time and expense that replicate the appearance and electrical efficiency of modern LED panels. This includes minimizing the amount of removal or demolition of the existing light fixtures, utilization of existing housings and/or anchor systems, and compatibility with existing control mechanisms. The present invention fulfills these needs and provides other related advantages.

SUMMARY OF THE INVENTION

The present invention is directed to a retrofit panel for use with a ceiling mounted light fixture. The retrofit panel includes a border frame that substantially approximates a size and shape of an opening of the light fixture. An open channel is disposed on a backside of the border frame generally about a perimeter thereof. An anchor assembly is slidingly disposed in the open channel. The anchor assembly is configured to attach to the light fixture proximate to the opening thereof and to maintain at least part of the retrofit panel within a predetermined anchor distance from the light fixture. A retainer assembly is also slidingly disposed in the open channel. The retainer assembly is configured to selectively retain the retrofit panel within the opening of the light fixture.

The retrofit panel may include two or more anchor assemblies and two or more retainer assemblies. More preferably, the retrofit panel may include four each of the anchor assemblies and the retainer assemblies. Multiple of each anchor assembly and retainer assembly are preferably distributed uniformly about the perimeter of the border frame.

The anchor assembly preferably includes an elongated anchor line having a base plug at one end which is slidingly disposed in the open channel. The other end of the elongated anchor line has an anchor device that is configured for attachment to the light fixture. The anchor device preferably includes a threaded screw configured to mate with a threaded hole in the light fixture or an anchor bar configured to selectively pass through an anchor port in the light fixture. The anchor device may also consist of lugs and channels, mechanical hooks, rivets, or other commonly known connection mechanisms.

The retainer assembly preferably includes a central hub that is slidingly disposed in the open channel. A pair of resilient arms extends outward from the central hub. The resilient arms are configured to flex toward each other such that a distal end of each of the resilient arms may pass through a retaining port in the light fixture. The retaining port preferably has a size a shape only slightly larger than the central hub of the retainer assembly. The distal end of each of the resilient arms has an off-set body oriented away from the other of the resilient arms. The off-set body on each of the resilient arms is configured to rest against an inner edge of the retaining port when initially passing through the retaining port. Substantially the entire length of the resilient arms is configured to pass through the retaining port such that the resilient arms may spring away from each other so as to hold the border frame substantially flush with the opening of the light fixture.

The retrofit panel preferably includes an LED light panel within the border frame. An LED driver is disposed on the backside of the retrofit panel and is configured to connect to an electrical source within the light fixture.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

The present invention is directed to a retrofit panel for replacing the lens or similar screen in existing ceiling-mounted light fixtures. More particularly, the present invention is directed to a retrofit panel that is configured to fit into the existing housing of a ceiling-mounted light fixture with minimal demolition or removal of previously installed components. While the following detailed description describes retrofit installation of an LED light panel into an existing ceiling-mounted fluorescent light fixture, the inventive retrofit panel and anchor/hanging system has application in potentially any type of light fixture. The retrofit panel may have a lens, screen, diffuser, LED panel, or other insert used in the openings of similar ceiling-mounted light fixtures.

Figure 1:
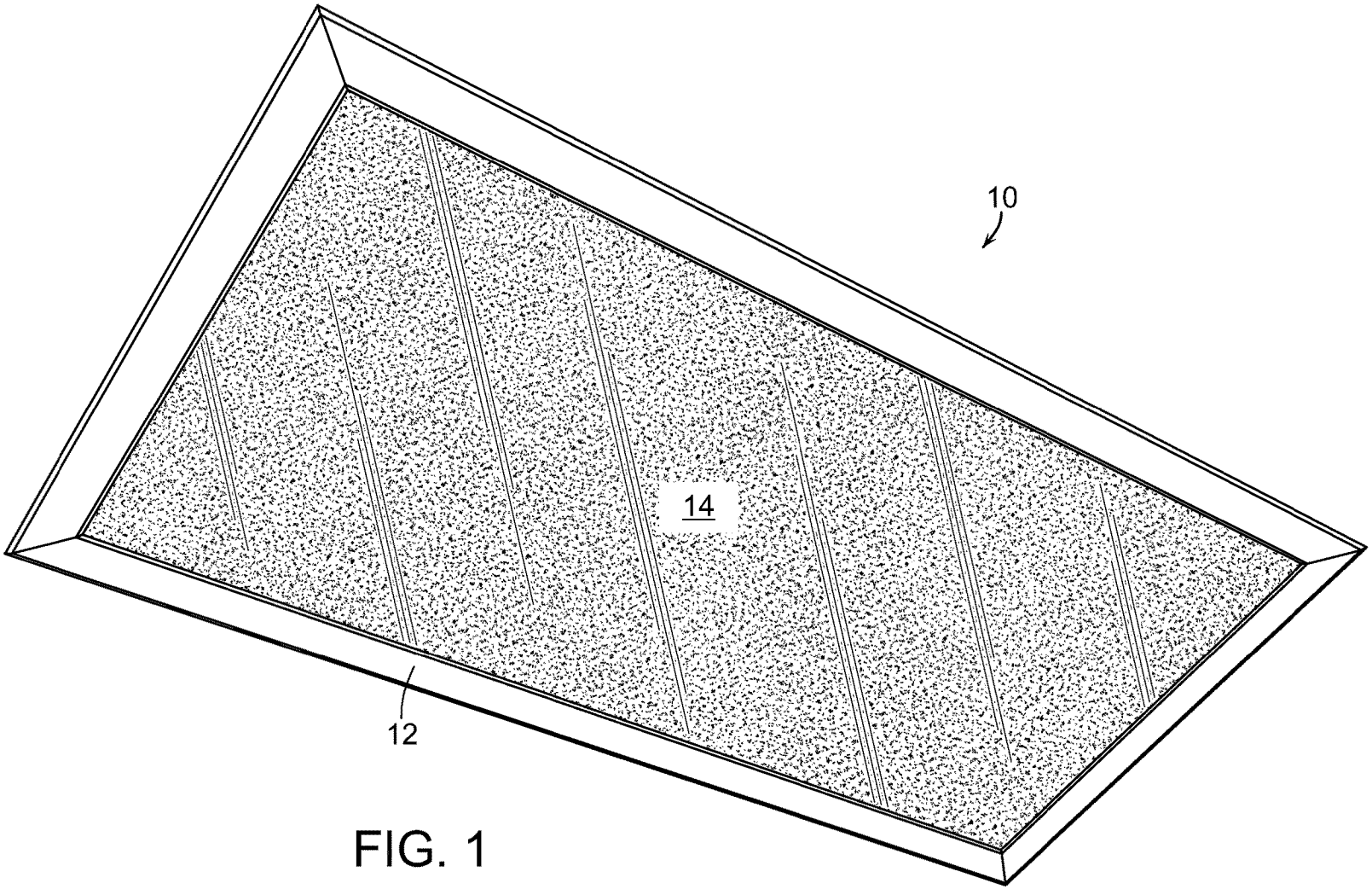
FIG. 1 is a perspective view illustrating a front side of a preferred embodiment of retrofit panel.
Figure 2:
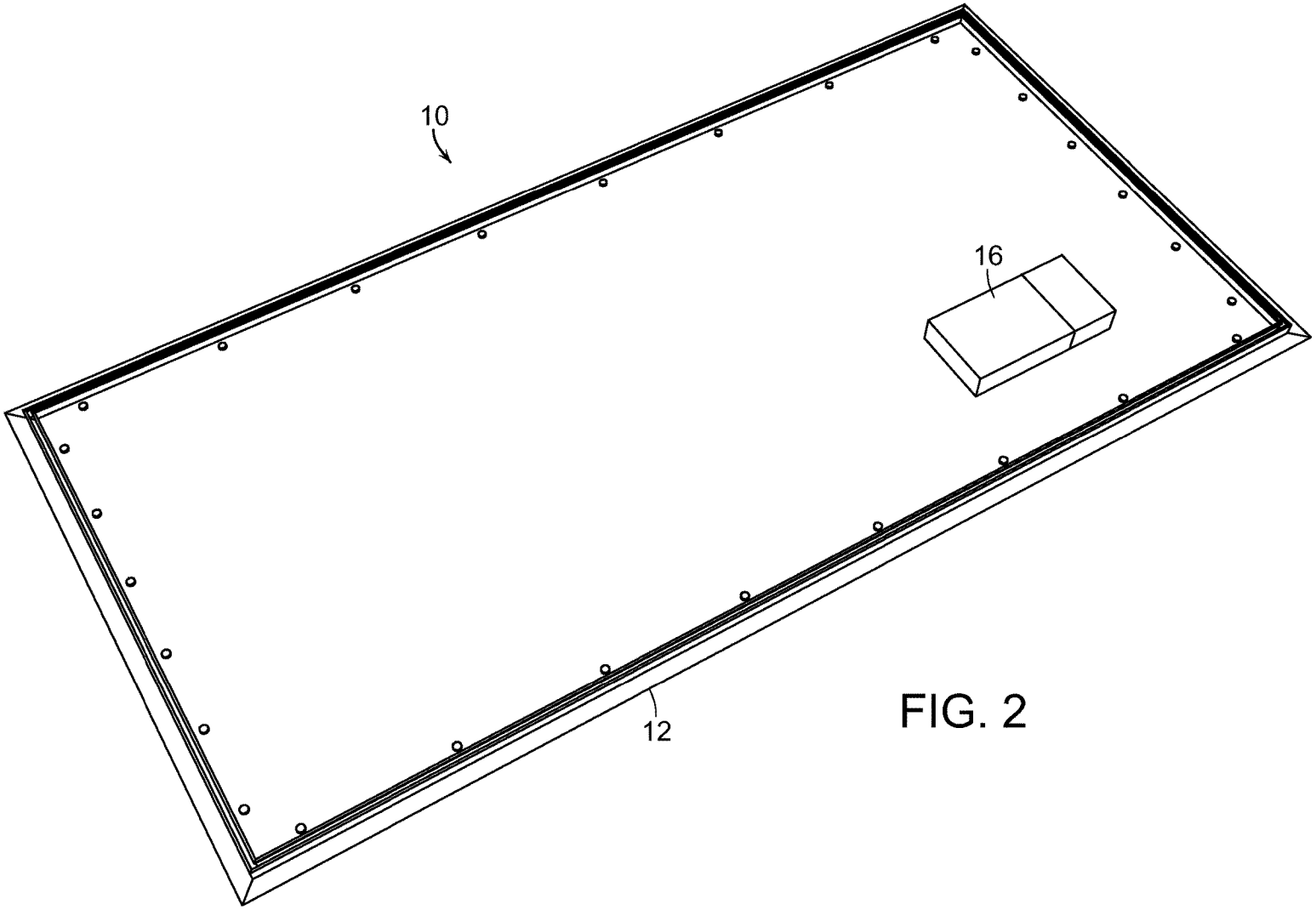
FIG. 2 is a perspective view illustrating a back side of the preferred embodiment of retrofit panel.
Figure 3:
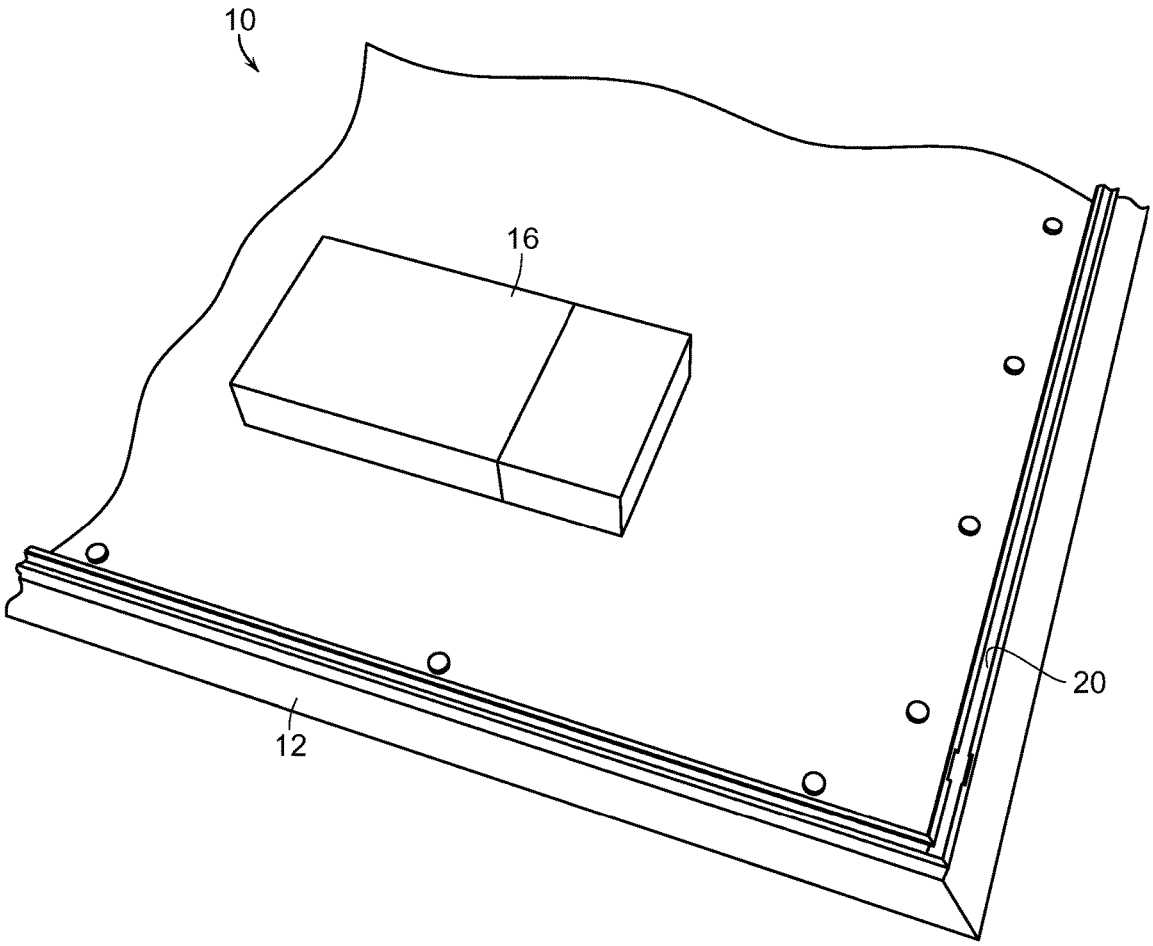
FIG. 3 is a partial perspective view illustrating an LED driver on the back side of the preferred embodiment of retrofit panel.

In the following description, the retrofit panel will be generally referred to as an LED light panel and identified by reference numeral 10. The electronics of the LED light panel 10 discussed herein are generally known to those skilled in the art, as described in US Patent Application Publication Nos. 2013/0033861 and 2015/0023010. As shown in FIGS. 1-3, the LED light panel 10 generally has a border frame 12 that encloses a sheet of LED bulbs (not shown) disposed behind a light diffusing lens 14. A driver 16 or similar control mechanism is disposed on a back side of the panel 10 opposite the lens 14. An electrical source (not shown) is connected to the driver 16 to power the LED light panel 10. The electrical source may be switched or otherwise adjustable.

In prior art LED light panels, the border frame is sized and configured to occupy the same space in a ceiling as the housing on a prior art ceiling-mounted light fixture. This would typically be the frame in a drop tile or hard lid ceiling, but may also be an opening in a drywall or stucco ceiling. Thus, in order to replace a prior art ceiling-mounted light fixture with a prior art LED light panel, one would need to remove all components of the prior art ceiling-mounted light fixture, including the housing with all internal components, e.g., the lens, the bulbs, ballasts, and other electrical components, and all anchor wires and other structural parts.

Figure 10:
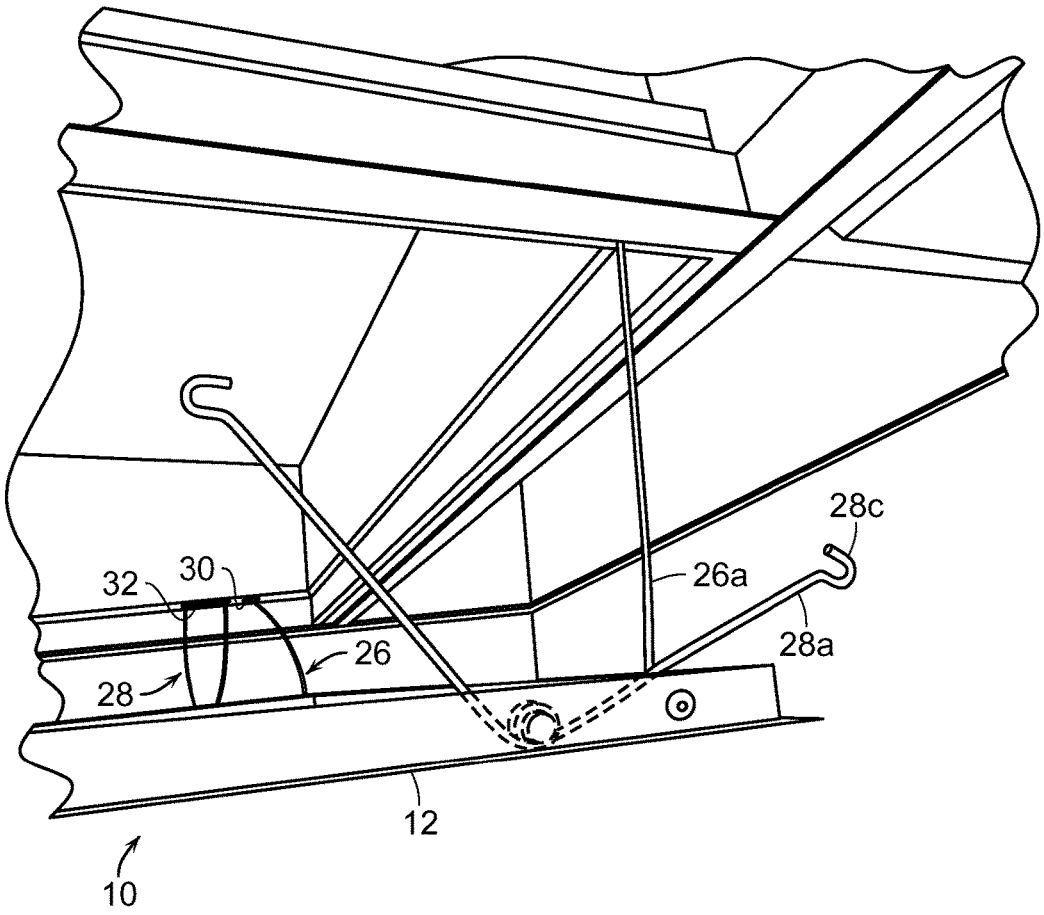
FIG. 10 is an environmental view showing installation of the preferred embodiment of a retrofit panel into a ceiling-mounted light fixture.
Figure 11:
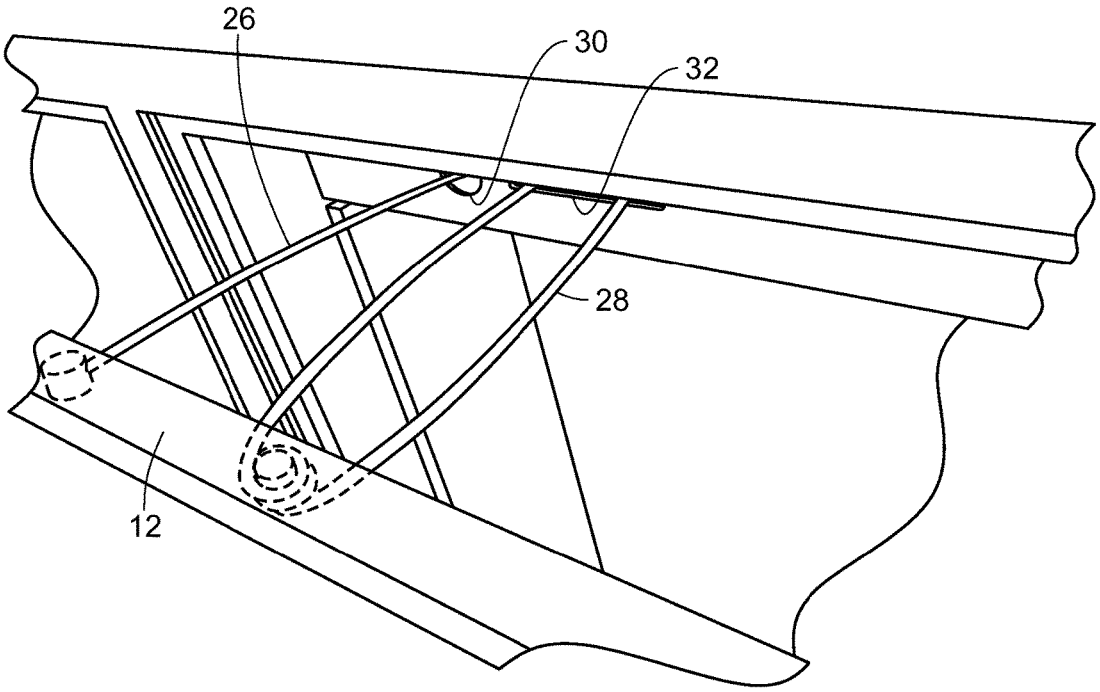
FIG. 11 is an environmental view showing a close-up installation of the anchor line and retainer arm assemblies into a ceiling-mounted light fixture.
Figure 12:
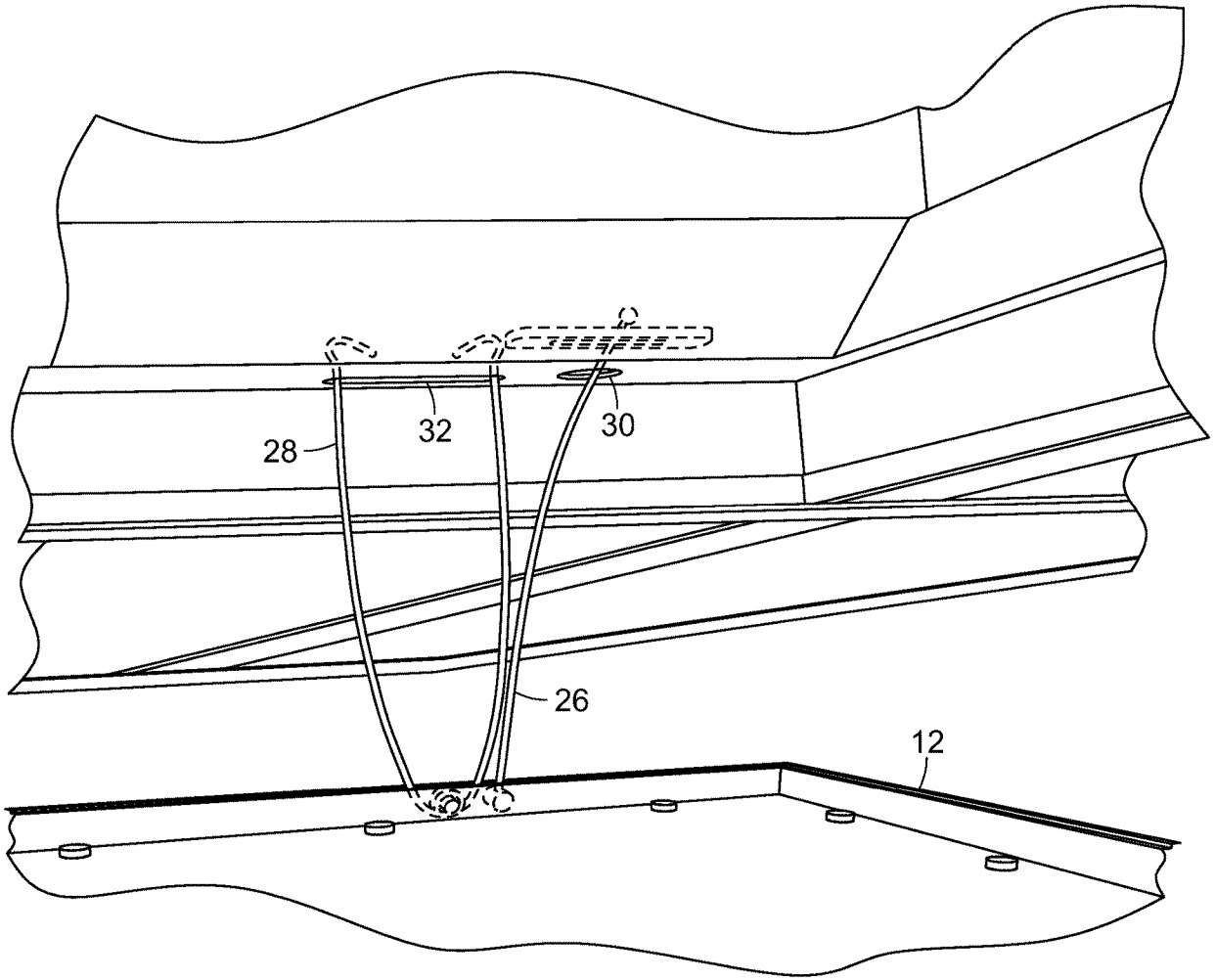
FIG. 12 is an environmental view showing a close-up installation of the anchor line and retainer arm assemblies into a ceiling-mounted light fixture.
Figure 13:
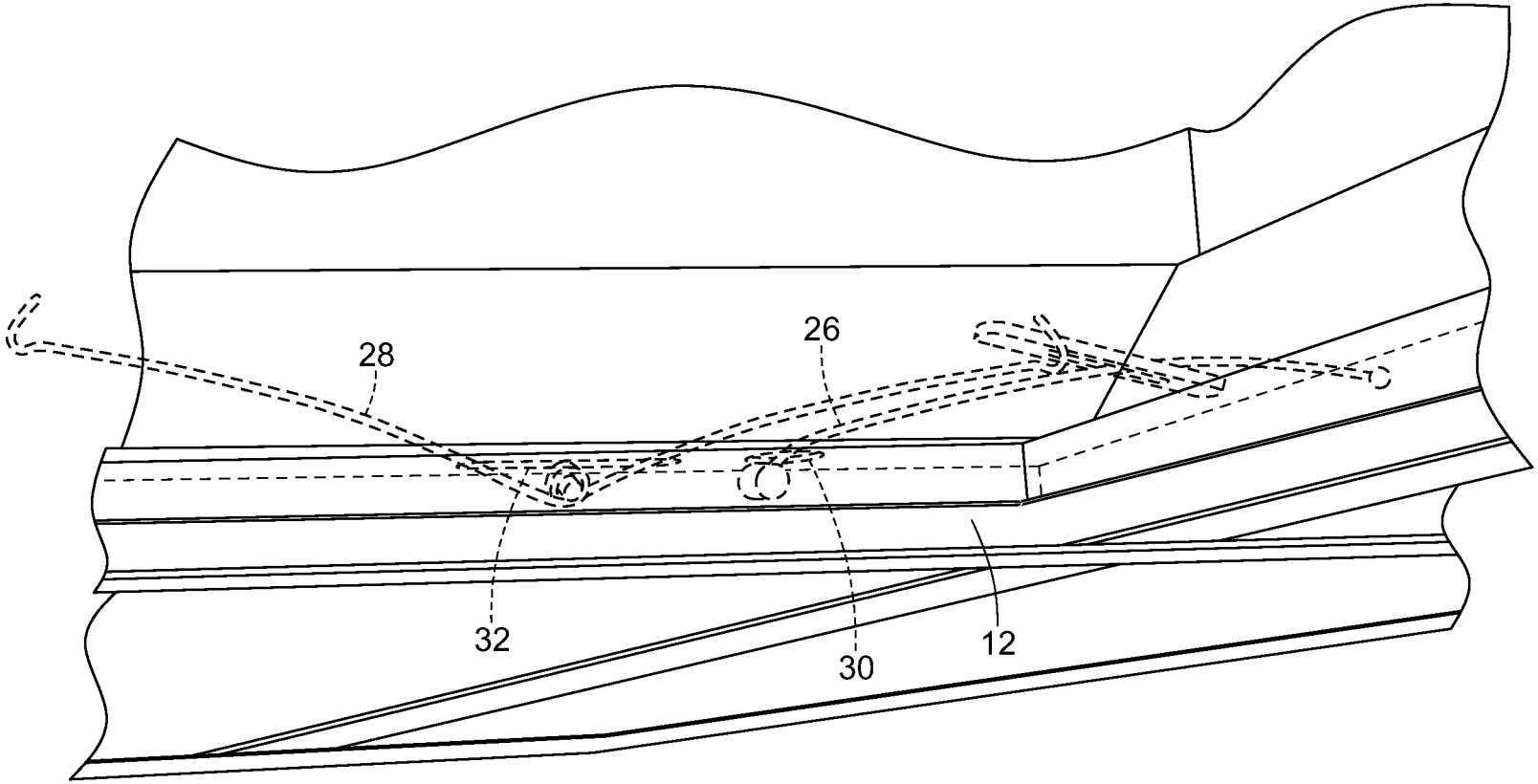
FIG. 13 is an environmental view showing a close-up of the anchor line and retainer arm assemblies when the retrofit panel is set flush with the opening of a ceiling-mounted light fixture.
Figure 14:
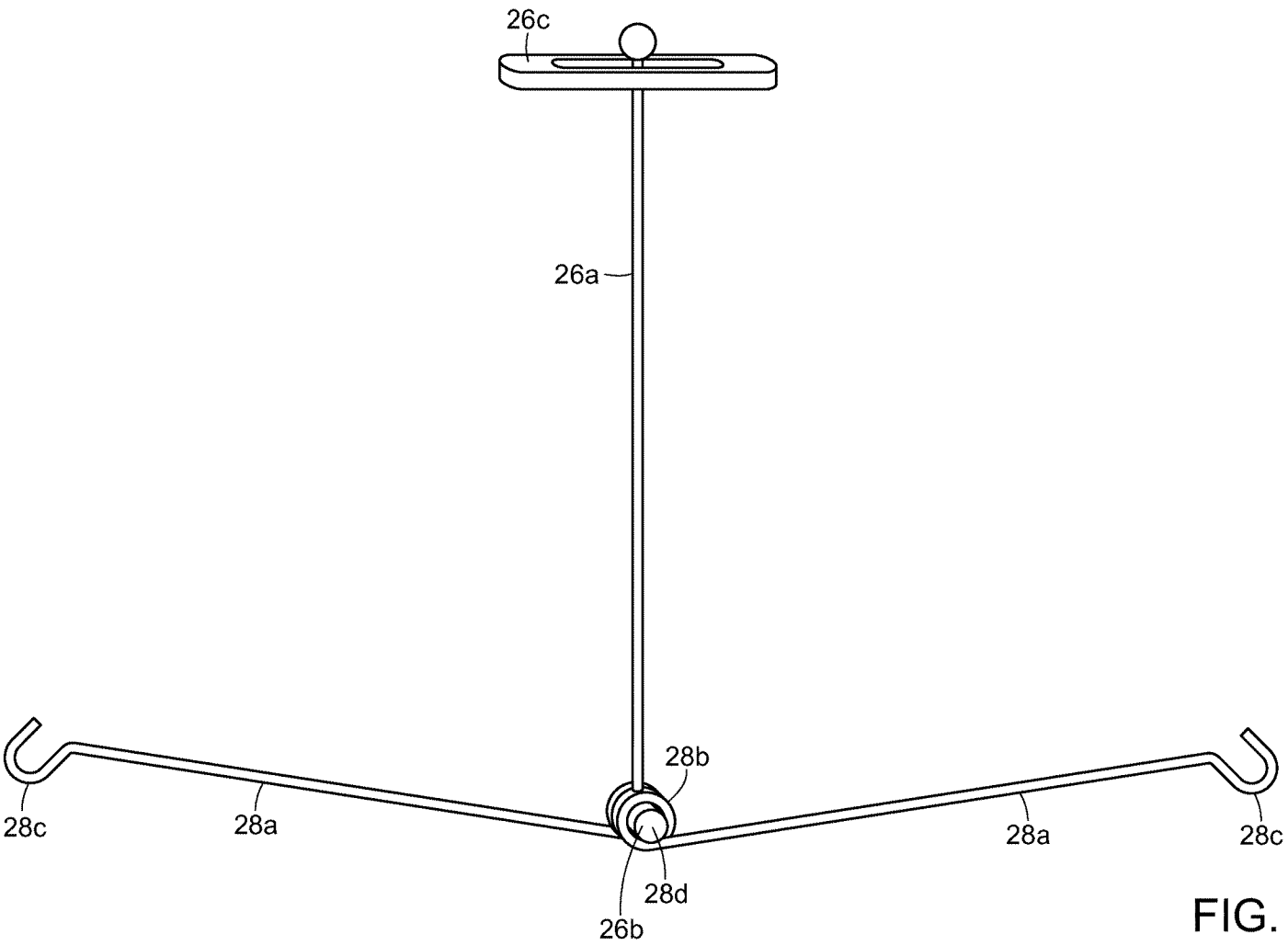
FIG. 14 is an illustration of a combined anchor line and retainer arm assembly of an alternate embodiment of a retrofit panel.

In contrast, the inventive LED light panel 10 is resized and reconfigured to fit within the opening of the housing 18 of an existing ceiling-mounted light fixture (FIGS. 10-12). Specifically, the border frame 12 is configured and sized so that the LED light panel 10 sits flush with the housing 18 as would the lens of the existing ceiling-mounted light fixture. This resizing and reconfiguring of the border frame 12 makes the inventive LED light panel 10 have a slightly smaller dimension than typical prior art LED light panels intended to replace standard 2×4 fluorescent light fixtures. Because the inventive LED light panel 10 occupies the same space as the lens of the existing ceiling-mounted light fixture, minimal removal of components is required as described more fully below. Despite this resizing, the inventive LED light panel 10 puts out the same light, watts, and lumens as prior art LED light panels.

Figure 4:
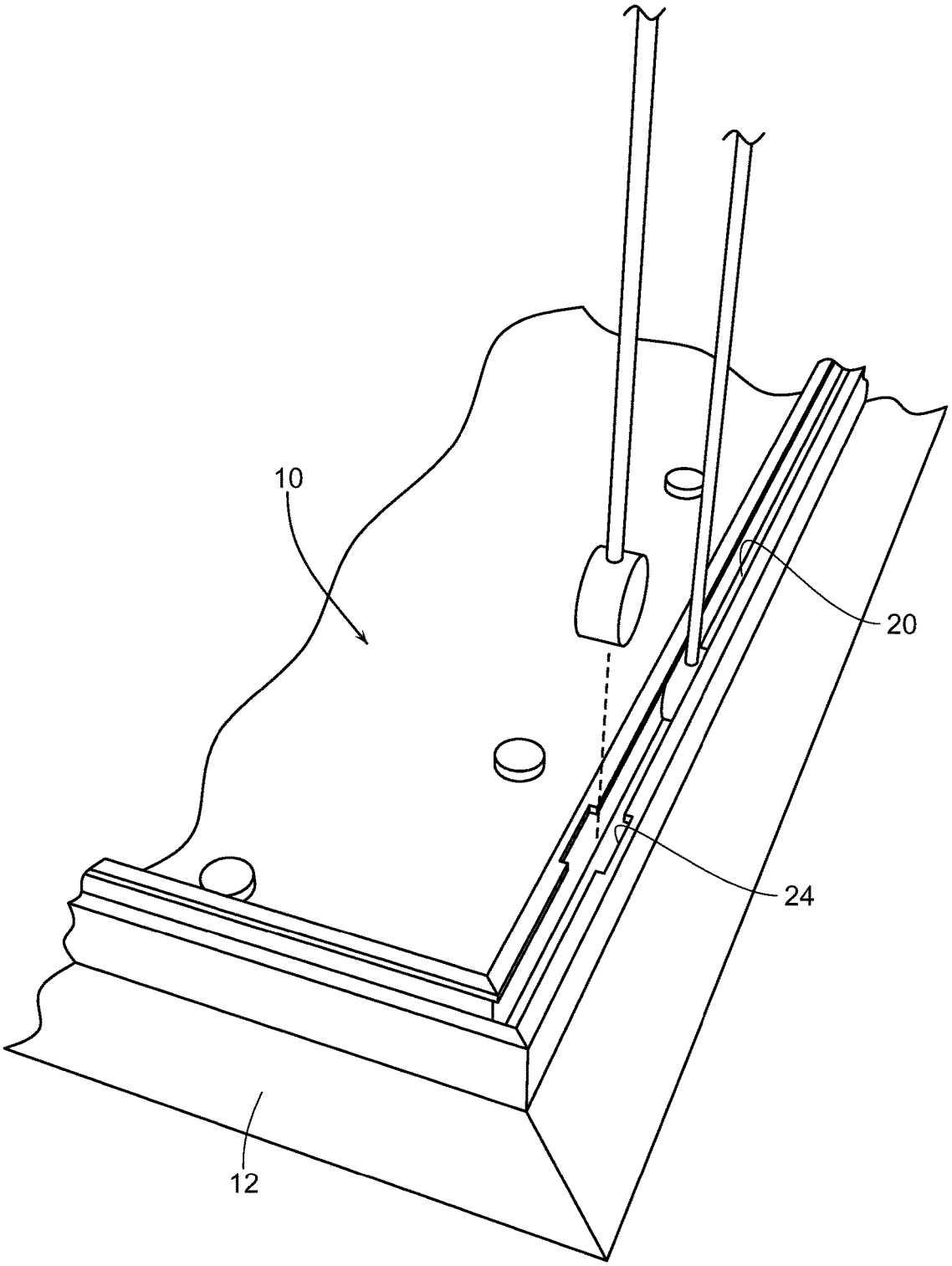
FIG. 4 is a partial perspective view illustrating a close up of a guide track of the preferred embodiment of a retrofit panel.
Figure 5:
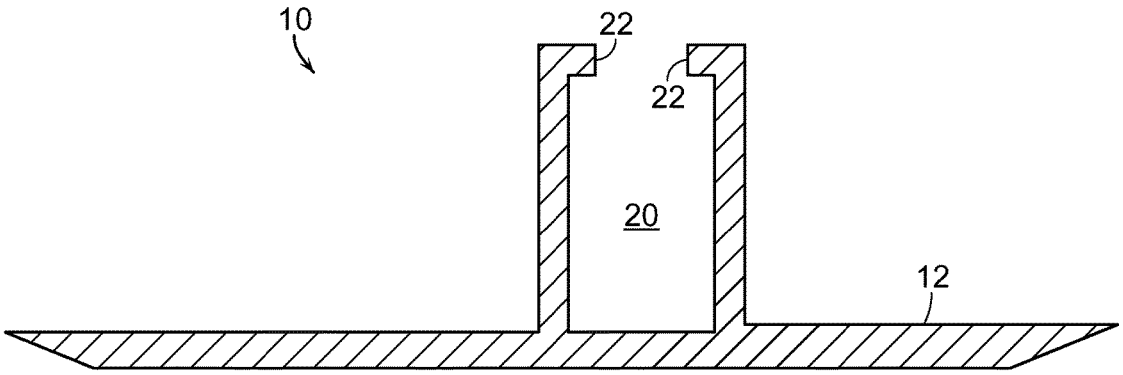
FIG. 5 is an illustration of a cross-sectional view of the guide track of the preferred embodiment of a retrofit panel.

As shown in FIGS. 4 and 5, the back-side of the border frame 12 includes a guide track 20 that preferably encircles the entire perimeter of the LED light panel 10. The guide track 20 has a generally U-shaped cross-section with extensions 22 partially enclosing the top of the U-shape all the way around the perimeter. One or more cut-outs 24 in the extensions 22 spaced around the perimeter to permit insertion of components into the guide track 20. Depending upon whether the guide track 20 has corners or rounded transitions, the panel 10 may need at least one cut-out 24 between each pair of corners on the guide track 20.

The guide track 20 is configured to accept one or more anchor line assemblies 26 and one or more retainer arm assemblies 28 such that they extend from the opening between the extensions 22 of the guide track 20. Preferably, the LED light panel 10 has at least two each of the anchor line assemblies 26 and retainer arm assemblies 28. In a particularly preferred embodiment, the LED light panel 10 includes four anchor line assemblies 26 and four retainer arm assemblies 28.

Figure 7:
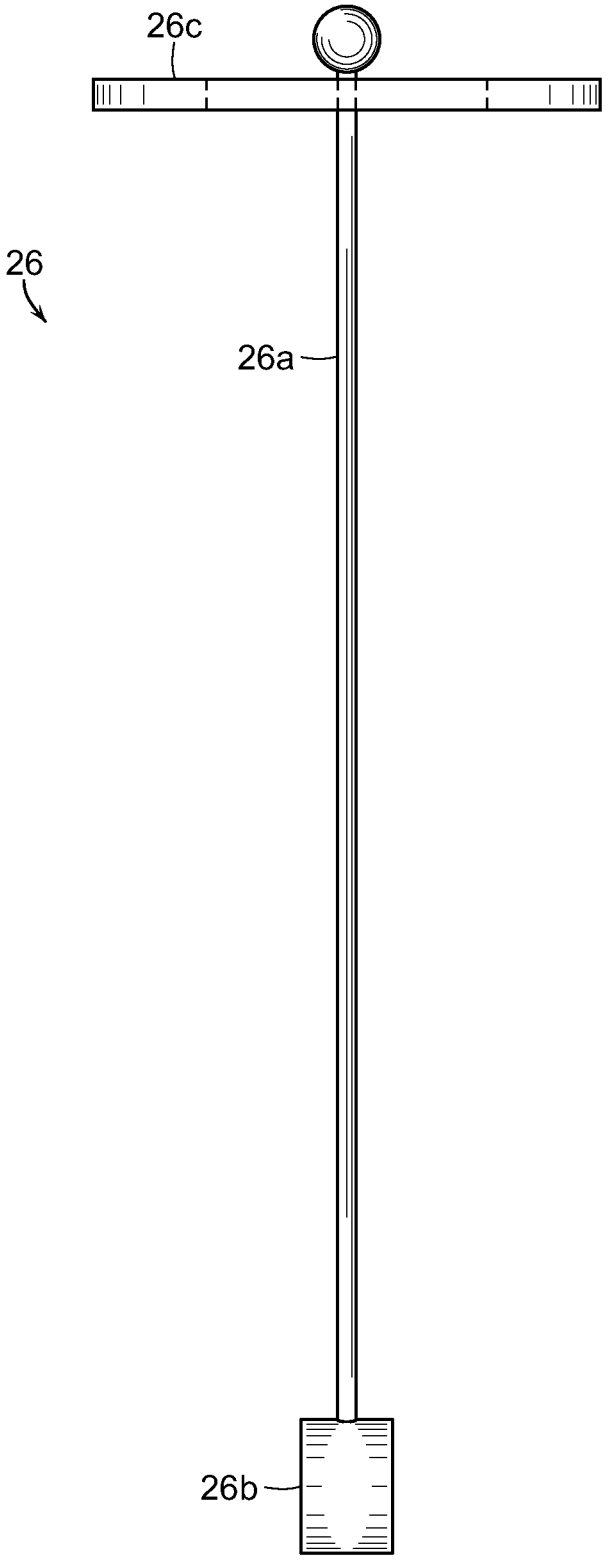
FIG. 7 is an illustration of an anchor line assembly of the preferred embodiment of a retrofit panel.
Figure 9:
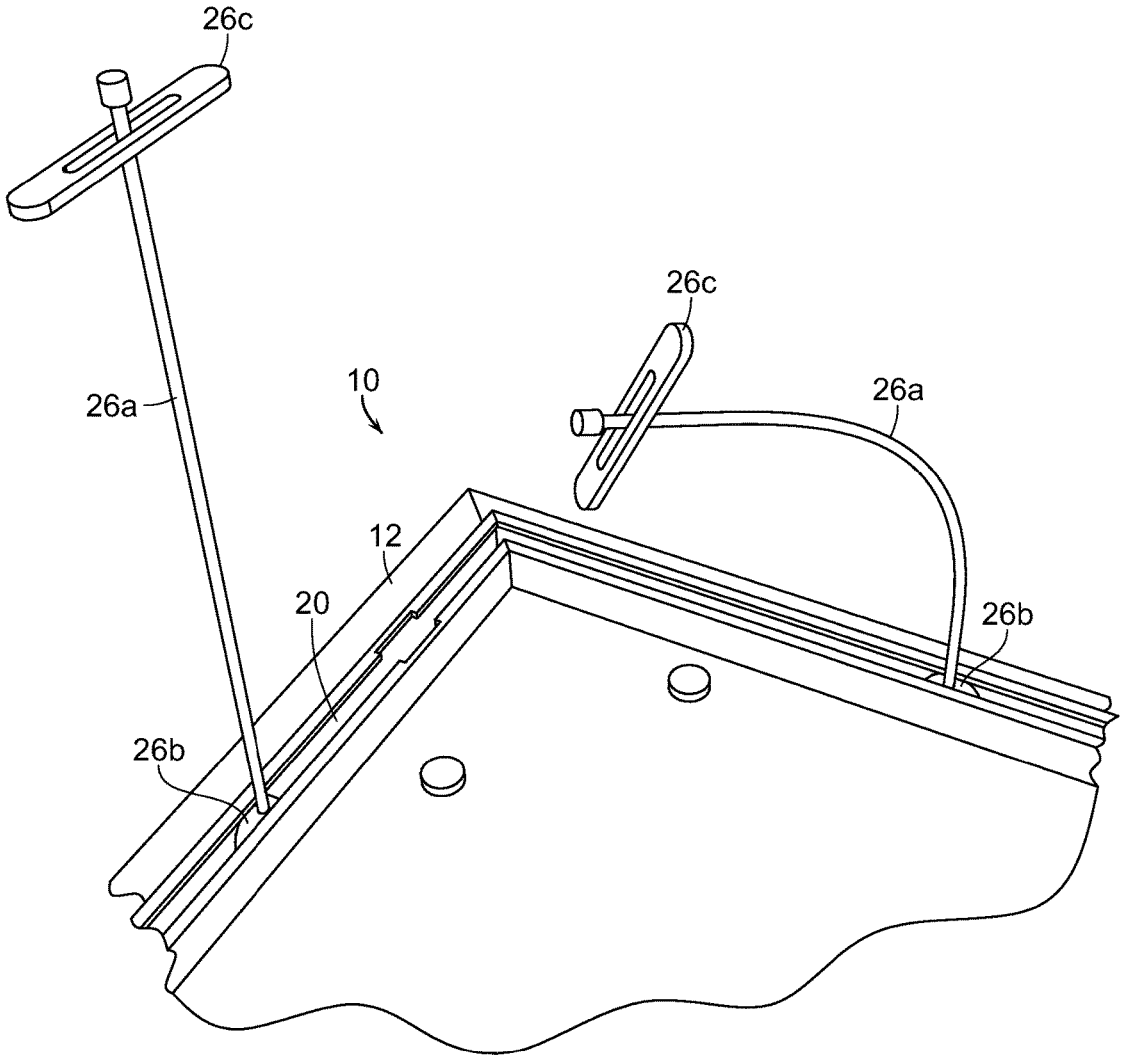
FIG. 9 is an illustration of multiple anchor line assemblies inserted in the guide track of the preferred embodiment of a retrofit panel.

As shown in FIG. 7, the anchor line assemblies 26 preferably each comprise a length of durable wire or cable 26*a*, a base plug 26*b* and an elongated cross-bar 26*c*. The base plug 26*b* is small enough to pass through the cut-out 24 and large enough to be retained in the guide track 20 by the extensions 22. Once inserted into the guide track 20, as shown in FIG. 9, the base plug 26*b* should slide freely around the guide track 20 such that the anchor line assembly 26 is adjustable in its position around the perimeter of the border frame 12. Also as shown in FIG. 9, the elongated cross-bar 26*c* of the anchor line assembly 26 is configured to pivot in relation to the cable 26*a*.

Figure 6A:
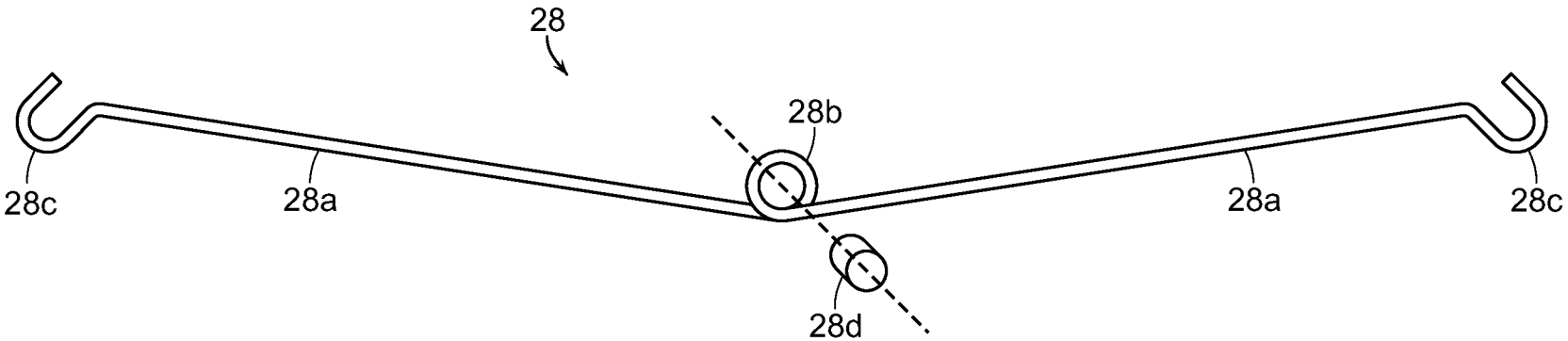
FIG. 6A is an illustration of a retainer arm assembly of the preferred embodiment of a retrofit panel.
Figure 6B:
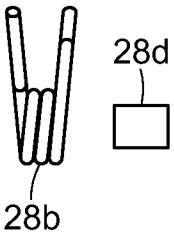
FIG. 6B is an illustration of a retainer arm assembly of the preferred embodiment of a retrofit panel.
Figure 8:
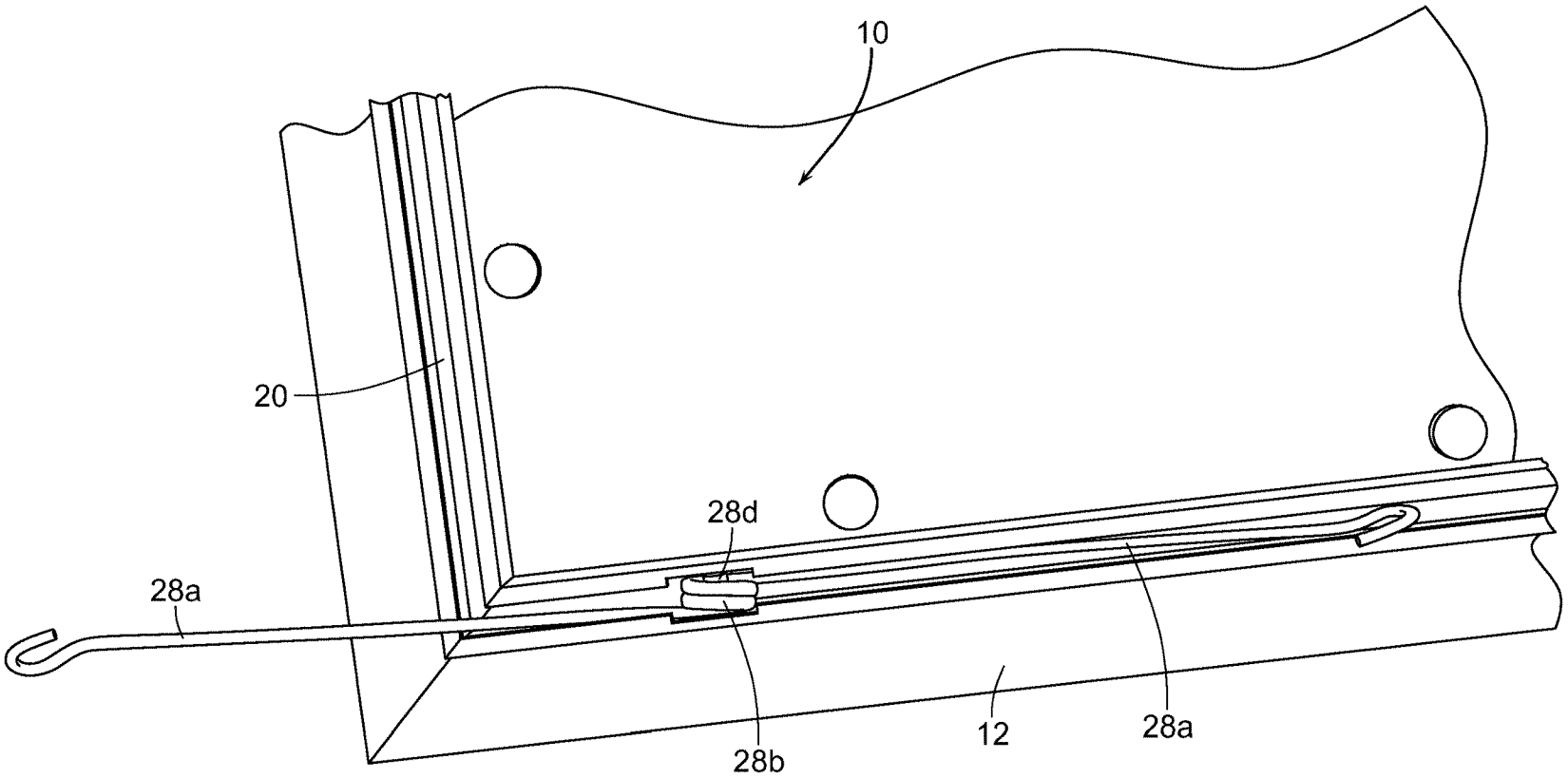
FIG. 8 is an illustration showing insertion of a retainer arm assembly into a cut-out of the guide track of the preferred embodiment of a retrofit panel.

As shown in FIGS. 6A and 6B, the retainer arm assemblies 28 preferably each comprise arms 28*a* that extend from a central hub 28*b* and end in an off-set body 28*c*. The central hub 28*b* preferably is coiled or has another configuration to impart resilience on the arms 28*a* such that they can flex inward and return to their initially extended position. As shown in FIG. 8, the central hub 28*b* should also have a dimension that is small enough to pass through the cut-out 24 and large enough to be retained in the guide track 20 by the extensions 22. Depending upon the configuration of the central hub 28*b*, the desired dimension can be achieved by a cylindrical body 28*d* that passes through the central hub 28*b* and is retained on each end by the extensions 22. After all anchor line assemblies 26 and retainer arm assemblies 28 are installed on the guide track 20, the cut-out 24 may be blocked by a pin or screw (not shown). Blocking the cut-out 24 is intended to prevent any of the anchor line assemblies 26 or retainer arm assemblies 28 from inadvertently passing back through the cut-out 24.

When installing the LED light panel 10 in an existing ceiling-mounted light fixture, as shown in FIGS. 10 and 11, the elongated cross-bar 26*c* is designed to pivot and pass through a port 30 in the housing 18. The port 30 is sized to permit the cross-bar 26*c* to pass through when pivoted, but retain the cross-bar 26*c* when it is oriented transverse to the port 30. The port 30 may be a pre-existing hole in the housing 18 or may be specially drilled by the installer to accept the anchor line assembly 26. When inserted into the port 30 in the housing 18 of an existing ceiling-mounted light fixture, the anchor line assembly 26 secures at least a portion of the LED light panel 10 a maximum distance from the light fixture equal to the length of the cable 26*a*. Preferably, the LED light panel 10 has at least two anchor line assemblies 26 spaced equally spaced around the perimeter of the border frame 12 so as to support the entire LED light panel 10. Most preferably, assuming a rectangular or square panel, the LED light panel 10 has four anchor line assemblies 26 positioned proximate to separate corners of the border frame 12 so as to fully support and balance the LED light panel 10 relative to the housing 18.

Once the anchor line assemblies 26 are connected to the housing 18, the installer may then connect the retainer arm assemblies 28 to the housing 18. The retainer arm assemblies 28 are configured to engage an opening 32 in the housing 18. The installer pinches the arms 28*a* together so that the off-set bodies 28*c* fit through the opening 32. Once the off-set bodies 28*c* are through the opening 32, the off-set bodies 28*c* will engage an edge of the opening 32 to help the LED light panel 10 hang from the housing 18. Preferably, the LED light panel 10 has at least two retainer arm assemblies 26 spaced equally spaced around the perimeter of the border frame 12 so as to support the entire LED light panel 10. If the LED light panel 10 has two anchor line assemblies 26, then preferably, the two retainer arm assemblies 28 are spaced equidistant from the anchor line assemblies 26. Most preferably, again assuming a rectangular or square panel, the LED light panel 10 has four retainer arm assemblies 28 positioned proximate to separate corners of the border frame 12 so as to fully support and balance the LED light panel 10 relative to the housing 18.

After the anchor lines assemblies 26 are connected to the housing 18 and either before or after the retainer arm assemblies 28 are connected to the housing 18, an installer may connect electrical power (not shown) to the driver 16. The anchor line assemblies 26 and retainer arm assemblies 28 help the LED light panel 10 to hang a pre-determined installation distance from the housing 18. This pre-determined installation distance is such that an installer can reach into the space to connect the electrical service. Once the electrical service is connected and tested to confirm that the LED light panel 10 operates, the installer simply pushes the LED light panel 10 upward against the housing 18.

As the arms 28*a* of the retainer arm assemblies 28 move further through the opening 32, the spring action of the central hub 28*b* forces the arms 28*a* outward from the pinched position. This outward movement of the arms 28*a* from the pinched position toward an extended position levers the arms 28*a* against an inner edge of the opening 32 and acts to draw the LED light panel 10 closer to the housing 18 and hold it there. Preferably, the LED light panel 10 engages the housing 18 closely enough so that the arms 28*a* reach their fully extended position or a substantially fully extended position. Once the arms 28*a* reach this extended position, the LED light panel 10 will be fully engaged with the housing 18 and be flush with the edge of the housing 18. It could also be flush with the ceiling if the housing is recessed.

To access and/or remove the LED light panel 10, one simply needs to pull down on the edge of the border frame 12 with sufficient force to pull the retainer arm assemblies 28 back through the openings 32. The inner edges of the openings 32 will pinch the arms 28*a* together against the spring force of the central hub 28*b* as the LED light panel 10 is pulled away from the housing 18. The off-set bodies 28*c* will catch the inner edges of the openings 32 and hold the LED light panel 10 in the retracted position. If the off-set bodies 28*c* fail to catch the edge of the opening 32 during the retraction process or if the retainer arm assemblies 28 fail for any reason, the anchor line assemblies 26 provide a failsafe against the LED light panel 10 falling out of the housing 18.

One particular advantage of the inventive LED light panel 18 is that it is easily retrofitted into existing ceiling-mounted light fixtures. To install the inventive LED light panel 10 into an existing ceiling-mounted light fixture, such as a standard 2×4 fluorescent light fixture, one need only remove the lens from the existing fixture. The LED light panel 10 occupies the same space as the lens in an existing fluorescent light fixture. The LED light panel 10 has a low profile such that none of the other components need to be removed from the existing fixture. For safety purposes and so that they do not break, the fluorescent bulbs should also be removed, but it is not necessary when installing the LED light panel 10. The ballasts and connection plugs for the old bulbs can be left in the fixture. This minimizes the demolition or deconstruction to needs to be done when installing an LED light panel 10.

Once the lens and bulbs are removed from an existing fixture, an LED light panel 10 can be installed in just a few minutes following the steps outlined above. This can provide tremendous savings in time and expense when retrofitting light fixtures for a large space or an entire building. The LED light panel 10 can be sized to fit other sizes of existing fixtures—1×2, 1×4, 2×2, 2×4, 4×4, etc. It can also be configured to fit styles of fixtures other than fluorescent light fixtures. The LED light panel 10 can be provided in any shape and size, e.g., round, triangular, etc., to match desired architecture. The only necessary features for installation are an existing housing mounted in the ceiling, a frame 12 on the LED light panel 10 that matches the ceiling or an opening in the ceiling, a channel 20 on the back side of the panel that contains the anchor line assemblies 26 and the retainer arm assemblies 28, and an existing electrical source to the housing that can be connected to the LED light panel 10.

This retrofit ability is particularly important in certain types of settings like hospitals or similar places where strict regulations are imposed. For example, hospitals in California have particular requirements for anchoring and securing light fixtures into ceilings. If an entire light fixture is to be removed and placed, in addition to the time and expense actually involved in removing and replacing the fixture with proper anchors, the contractor would need to draw up new plans for the work and have those plans approved before starting work. In contrast, retrofitting existing light fixture housings with the inventive LED light panel 10, would avoid the need to draw up plans, remove the old light fixtures and anchor lines, and install the new light fixtures with proper anchor lines. By using the existing housings, a contractor could have a two-person crew quickly retrofit a floor or an entire building of ceiling-mounted light fixtures. One person would go through removing the lens and bulbs from each existing light fixture and making sure that the housing 18 had proper ports 30 and openings 32. The second person would then follow behind and install the LED light panel 10 as described above. The installation can be done simply and quickly by one person.

Although several embodiments have been described in detail for purposes of illustration, various modifications may be made without departing from the scope and spirit of the invention. Accordingly, the invention is not to be limited, except as by the appended claims.

What is claimed is:

1. A retrofit light panel, comprising:

a border frame that substantially approximates a size and shape of an opening of a light fixture housing;

an open channel disposed on a backside of the border frame generally about a perimeter thereof;

an anchor assembly slidingly disposed in the open channel; and a retainer assembly slidingly disposed in the open channel.

2. The retrofit light panel of claim 1, comprising two or more anchor assemblies and two or more retainer assemblies.

3. The retrofit light panel of claim 1, wherein the anchor assembly is configured to attach to the light fixture housing proximate to the opening thereof, and comprises an elongated anchor line having a base plug at one end disposed in the open channel and an anchor means at an opposite end configured for attachment to the light fixture housing.

4. The retrofit light panel of claim 3, wherein the anchor means comprises a threaded screw configured to mate with a threaded hole in the light fixture or an anchor bar configured to selectively pass through an anchor port in the light fixture housing.

5. The retrofit light panel of claim 1, wherein the retainer assembly is configured to selectively retain the retrofit light panel within the opening of the light fixture housing, and comprises a central hub disposed in the open channel and a pair of resilient arms extending outward from the central hub.

6. The retrofit light panel of claim 5, wherein the resilient arms are configured to flex toward each other such that a distal end of each of the resilient arms may pass through a retaining port in the light fixture housing.

7. The retrofit light panel of claim 6, wherein the distal end of each of the resilient arms has an off-set body oriented away from the other of the resilient arms such that the off-set body on each of the resilient arms is configured to rest against an inner edge of the retaining port when initially passing through the retaining port.

8. The retrofit light panel of claim 6, wherein substantially an entire length of the resilient arms is configured to pass through the retaining port such that the resilient arms spring away from each other so as to hold the border frame substantially flush with the opening of the light fixture housing.

9. The retrofit light panel of claim 1, further comprising an LED light panel contained within the border frame and an LED driver disposed on a backside of the retrofit light panel configured to connect to an electrical source within the light fixture housing.

10. A retrofit light panel, comprising:

a border frame that substantially approximates a size and shape of an opening of a light fixture housing;

an open channel disposed on a backside of the border frame generally about a perimeter thereof;

at least two anchor assemblies slidingly disposed in the open channel;

at least two retainer assemblies slidingly disposed in the open channel; and an LED light panel contained within the border frame and an LED driver disposed on a backside of the retrofit light panel configured to connect to an electrical source within the light fixture housing.

11. The retrofit light panel of claim 10, wherein each of the anchor assemblies is configured to attach to the light fixture housing proximate to the opening thereof, and comprise an elongated anchor line having a base plug at one end disposed in the open channel and an anchor means at an opposite end configured for attachment to the light fixture housing.

12. The retrofit light panel of claim 11, wherein the anchor means comprises a threaded screw configured to mate with a threaded hole in the light fixture or an anchor bar configured to selectively pass through an anchor port in the light fixture housing.

13. The retrofit light panel of claim 10, wherein each of the retainer assemblies is configured to selectively retain the retrofit light panel within the opening of the light fixture housing, and comprise a central hub disposed in the open channel and a pair of resilient arms extending outward from the central hub.

14. The retrofit light panel of claim 13, wherein the resilient arms are configured to flex toward each another such that a distal end of each of the resilient arms may pass through a retaining port in the light fixture housing.

15. The retrofit light panel of claim 14, wherein the distal end of each of the resilient arms has an off-set body oriented away from the other of the resilient arms such that the off-set body on each of the resilient arms rests against an inner edge of the retaining port when initially passing through the retaining port.

16. The retrofit light panel of claim 15, wherein substantially an entire length of the resilient arms is configured to pass through the retaining port such that the resilient arms spring away from each other so as to hold the border frame substantially flush with the opening of the light fixture housing.

17. A retrofit light panel, comprising:

a border frame that substantially approximates a size and shape of an opening of a light fixture housing;

an open channel disposed on a backside of the border frame generally about a perimeter thereof;

at least two anchor assemblies each comprising an elongated anchor line having a base plug at one end and an anchor means at an opposite end, wherein the base plug is slidingly disposed in the open channel and the anchor means is configured for attachment to the light fixture housing proximate to the opening thereof;

at least two retainer assemblies each comprising a central hub slidingly disposed in the open channel and a pair of resilient arms extending outward from the central hub, wherein the resilient arms are configured to flex toward each another such that a distal end of each of the resilient arms may pass through a retaining port in the light fixture housing and substantially an entire length of each of the resilient arms is configured to pass through the retaining port such that the resilient arms spring away from each other so as to hold the border frame substantially flush with the opening of the light fixture housing; and an LED light panel contained within the border frame and an LED driver disposed on a backside of the retrofit light panel configured to connect to an electrical source within the light fixture housing.

18. The retrofit light panel of claim 17, comprising four anchor assemblies and four retainer assemblies.

19. The retrofit light panel of claim 17, wherein the anchor means comprises a threaded screw configured to mate with a threaded hole in the light fixture housing or an anchor bar configured to selectively pass through an anchor port in the light fixture housing.

20. The retrofit light panel of claim 17, wherein the distal end of each of the resilient arms has an off-set body oriented away from the other of the resilient arms such that the off-set body on each of the resilient arms rests against an inner edge of the retaining port when initially passing through the retaining port.

* * * * *